US007717719B2

(12) United States Patent
Miyazaki et al.

(10) Patent No.: US 7,717,719 B2
(45) Date of Patent: May 18, 2010

(54) CONNECTOR

(75) Inventors: Yoji Miyazaki, Tsu (JP); Kenji Okura, Tsu (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 2 days.

(21) Appl. No.: 12/196,569

(22) Filed: Aug. 22, 2008

(65) Prior Publication Data

US 2009/0061655 A1 Mar. 5, 2009

(30) Foreign Application Priority Data

Aug. 31, 2007 (JP) ..... 2007-226880

(51) Int. Cl.
*H01R 12/00* (2006.01)

(52) U.S. Cl. ..... 439/74

(58) Field of Classification Search ..... 439/74, 439/567–570, 607.35, 607.36
See application file for complete search history.

(56) References Cited

U.S. PATENT DOCUMENTS

| | | | | |
|---|---|---|---|---|
| 5,626,482 | A * | 5/1997 | Chan et al. | 439/74 |
| 5,727,956 | A * | 3/1998 | Mitra et al. | 439/74 |
| 6,095,824 | A * | 8/2000 | McHugh | 439/74 |
| 7,052,286 | B2 * | 5/2006 | Zhang | 439/74 |
| 7,172,434 | B2 * | 2/2007 | Obikane et al. | 439/74 |
| 2007/0049119 | A1 | 3/2007 | Fujimoto et al. | |
| 2008/0227334 | A1 | 9/2008 | Yoshioka et al. | |
| 2008/0242131 | A1 | 10/2008 | Tanaka et al. | |
| 2008/0242135 | A1 | 10/2008 | Fujimoto et al. | |
| 2008/0242143 | A1 | 10/2008 | Tanaka et al. | |

FOREIGN PATENT DOCUMENTS

| | | |
|---|---|---|
| JP | 10-208816 | 8/1998 |
| JP | 11-233201 | 8/1999 |
| JP | 2002-352914 | 12/2002 |
| JP | 2005-71769 | 3/2005 |
| JP | 2006-59589 | 3/2006 |
| JP | 2006-202645 | 8/2006 |

OTHER PUBLICATIONS

English language Abstract of JP 2006-59589, Mar. 2, 2006.

* cited by examiner

*Primary Examiner*—Truc T Nguyen
(74) *Attorney, Agent, or Firm*—Greenblum & Bernstein, P.L.C.

(57) ABSTRACT

To provide a connector that enhances the reliability of connection between the ground and a shield constituting a shell. A socket constitutes the connector together with a header which is mounted on a different printed wiring board. The socket includes a socket body which is provided with a connection recess, a plurality of socket contacts which are held by the socket body, and a pitch direction shield and a terminal direction shield constituting the shell which surround the connection recess and which prevents electromagnetic noise from coming in and out. The pitch direction shield and the terminal direction shield are provided with terminals soldered to conductive pattern of the ground.

4 Claims, 16 Drawing Sheets

CONNECTOR

BACKGROUND OF THE INVENTION

1. Field of the Invention

The present invention relates to a connector.

2. Description of the Related Art

Conventionally, as a connector which electrically connects printed wiring boards to each other, there is a known connector including a header mounted on a first printed wiring board and a socket mounted on a second printed wiring board which is opposed to the first printed wiring board.

As a connector of this kind, there is one having a socket 2 as shown in FIGS. 1A and 1B (for example, see Japanese Patent Application Laid-open No. 2006-59589).

The socket 2 includes a socket body 5 which is made of insulation material and provided with a connection recess 20. A header is inserted into and pulled out from the connection recess 20 in a predetermined insertion/withdrawal direction ID (vertical direction in FIG. 1B). The socket 2 also includes a plurality of socket contacts 6 held by the socket body 5 such that the socket contacts 6 come into contact with and brought into conduction with header contacts 4 which are conductive members on the side of the header when the header is inserted into the connection recess 20. The socket contacts 6 come into contact with the header contacts inside the connection recess 20. Each socket contact 6 includes a terminal 61 electrically soldered to the second printed wiring board. The socket 2 is provided with a plurality of pairs of socket contacts 6 having the terminals 61 projecting (vertical direction in FIG. 1A, "terminal direction TD", hereinafter) from the socket body 5 in opposite directions from each other in a direction (lateral direction in FIG. 1A, hereinafter, "pitch direction PD") intersecting with the insertion/withdrawal direction ID and the terminal direction TD.

Pitch direction shields 81 are held at both ends of the pitch direction PD of the socket body 5, and terminal direction shields 82 are held at both ends of the socket body 5 in the terminal direction TD.

The pitch direction shields 81 and the terminal direction shields 82 are made of metal plates and electrically grounded. The pitch direction shields 81 and the terminal direction shields 82 constitute an annular shell surrounding the connection recess 20 as viewed from the insertion/withdrawal direction ID, and the pitch direction shields 81 and the terminal direction shields 82 prevent electromagnetic noise from being mixed into electrical signals sent through the socket contact 6. If the shell is made up of the pitch direction shields 81 and the terminal direction shields 82 as described above, there is a merit that it is only necessary to change the terminal direction shield 82 in a connector having different number of pairs of the socket contacts 6, the pitch direction shields 81 can commonly be used, and as compared with a case that the shell is made up of only one part, it is easy to produce the connector.

More specifically, the terminal direction shield 82 includes a body portion 82*a* whose thickness direction is oriented in the terminal direction TD, and a terminal 82*c* projecting outward in the terminal direction TD from a lower end of the body portion 82*a*. The terminal direction shield 82 is soldered to a conductive pattern ("ground pattern", hereinafter) which is provided on the second printed wiring board and electrically grounded. With this arrangement, the terminal direction shield 82 is electrically grounded.

Each pitch direction shield 81 includes a body portion 81*a* whose thickness direction is oriented in the pitch direction PD, and an arms 81*f* projecting inward in the pitch direction PD from both ends of the body portion 81*a* in the terminal direction. The arms 81*f* come into elastic contact with the body portions 82*a* of the terminal direction shield 82, and the pitch direction shield 81 is electrically grounded through the terminal direction shield 82.

However, since the pitch direction shield 81 is grounded through the terminal direction shield 82, the reliability of connection between the pitch direction shield 81 and the ground is poor.

SUMMARY OF THE INVENTION

It is an object of the present invention to provide a connector capable of enhancing the reliability of connection between the ground and a shield constituting a shell.

The present invention provides a connector comprising a header mounted on a first printed wiring board, and a socket mounted on a second printed wiring board opposed to the first printed wiring board, wherein the header includes a header body made of an insulation material, and a plurality of header contacts which are each held by the header body and electrically connected to the first printed wiring board, the socket includes a socket body which is made of an insulation material and which is provided with a connection recess into and from which the header is inserted and pulled out, a plurality of socket contacts which are each held by the socket body and electrically connected to the second printed wiring board such that the socket contacts are brought into contact and conduction with the corresponding header contacts inside the connection recess when the header is inserted into the connection recess, and a shell which is made of a conductive material and which is held by the socket body such as to surround a periphery of the connection recess as viewed from an insertion/withdrawal direction of the header, each of the socket contacts includes terminals which project from the socket body as viewed from the insertion/withdrawal direction and which are soldered to the second printed wiring board, the socket is provided with a plurality of pairs of socket contacts in which terminal directions as terminal projecting directions from the socket body are opposite from each other are arranged in a pitch direction which is a direction intersecting with the insertion/withdrawal direction and the terminal direction, the shell includes pitch direction shields which are provided on both ends of the socket body in the pitch direction, and terminal direction shields which are provided on both ends of the socket body in the terminal direction, and the pitch direction shields and the terminal direction shields have corresponding terminals which are soldered to ground patterns provided on the second printed wiring board.

According to the present invention, the socket body can be a synthetic resin molded article in which the pitch direction shield is insert molded.

According to the present invention, it can be configured that at least one press-fit rib projects from each of both side surfaces of the socket body in the terminal direction, and the terminal direction shields are formed with press-fit notches to which the press-fit ribs are press fitted, and the terminal direction shield is held by the socket body by press fitting the press-fit ribs into the press-fit notches.

According to the present invention, it can be configured that both ends of the header in a direction corresponding to the terminal direction are formed with ground contacts which are made of conductive material, are held by the header body and which are electrically connected a ground pattern of the first printed wiring board, the terminal direction shield includes contact portions which are made of elastically deformable material, and which come into elastic contact with the ground contact of the header inserted into the connection recess from a direction intersecting with the insertion/withdrawal direction.

DETAILED DESCRIPTION OF THE PREFERRED EMBODIMENTS

Preferred embodiments of the present invention will be explained below with reference to FIGS. 2 to 16.

Figure 1A:
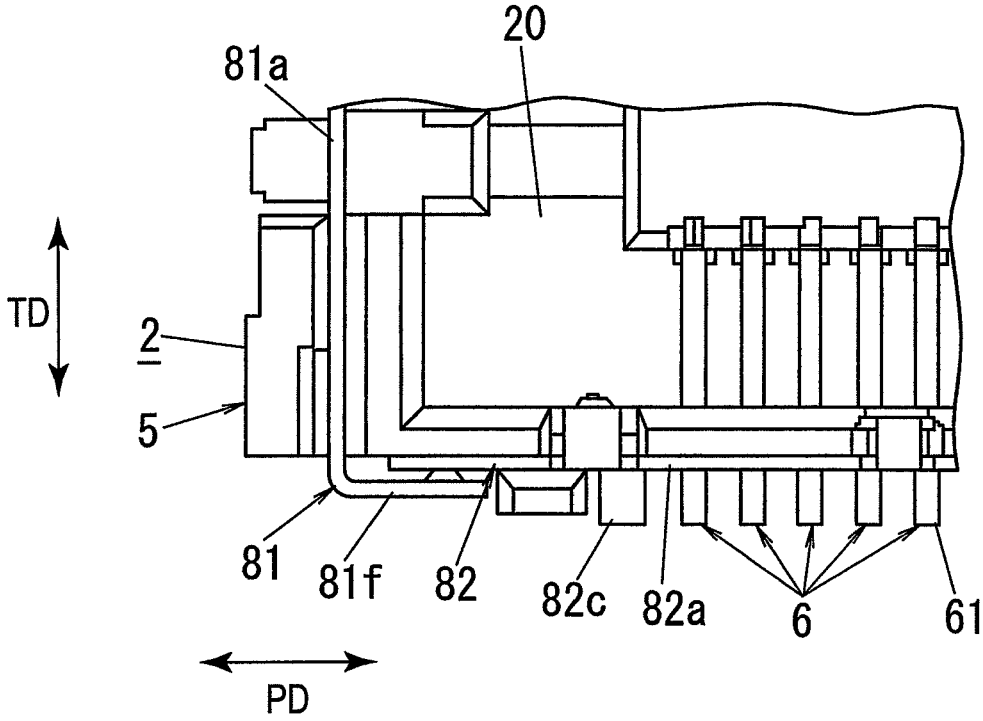
FIG. 1A RELATED ART
FIG. 1A is a plan view showing relevant parts of a socket of a conventional connector.
Figure 1B:
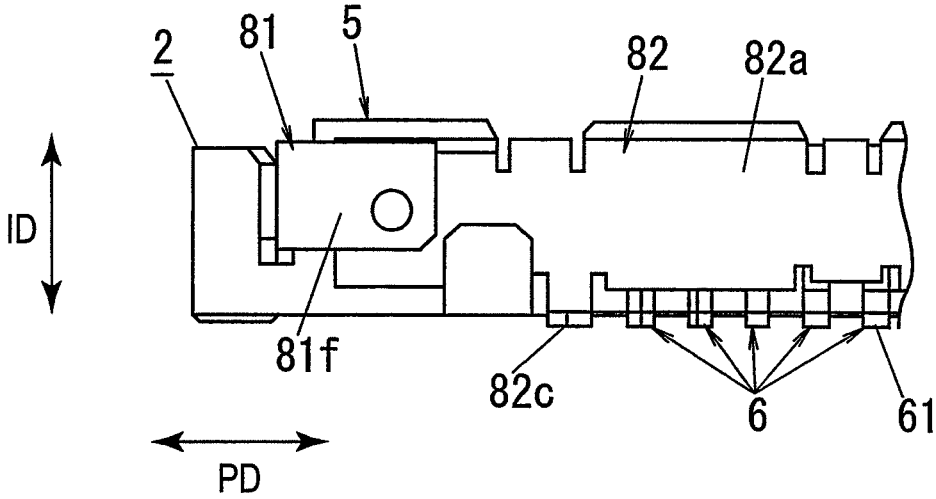
FIG. 1B RELATED ART
FIG. 1B is a front view showing the relevant parts of the socket of the conventional connector.
Figure 2:
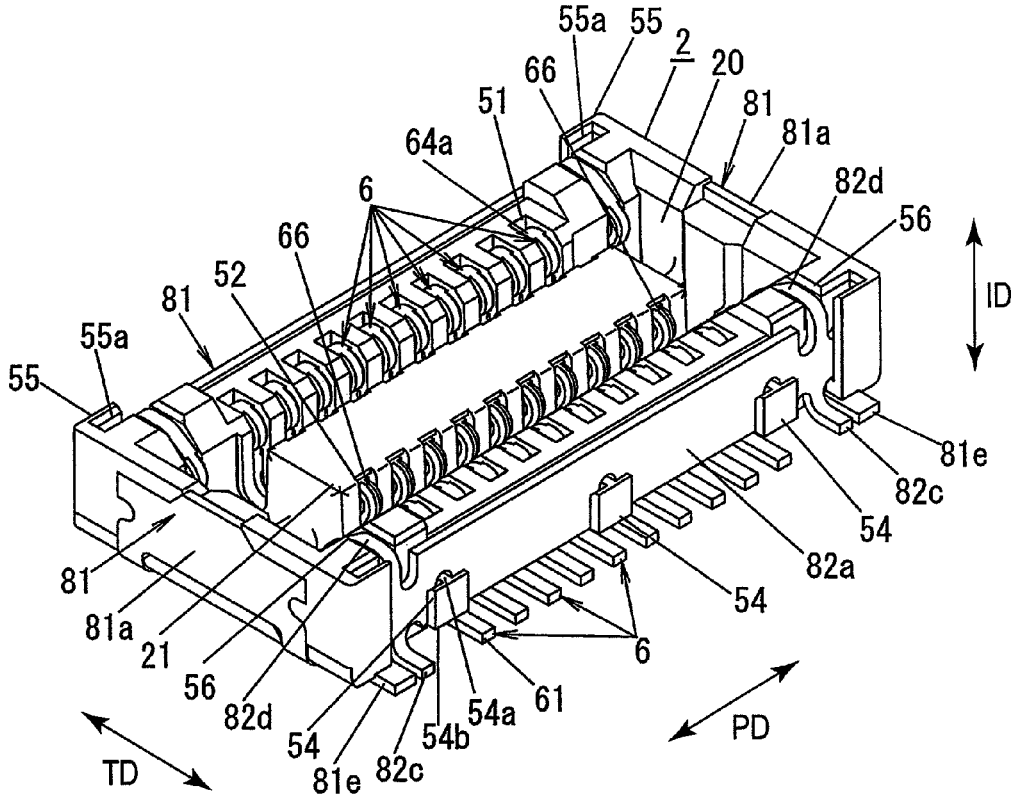
FIG. 2 is a perspective view showing a socket according to an embodiment of the present invention.
Figure 3:
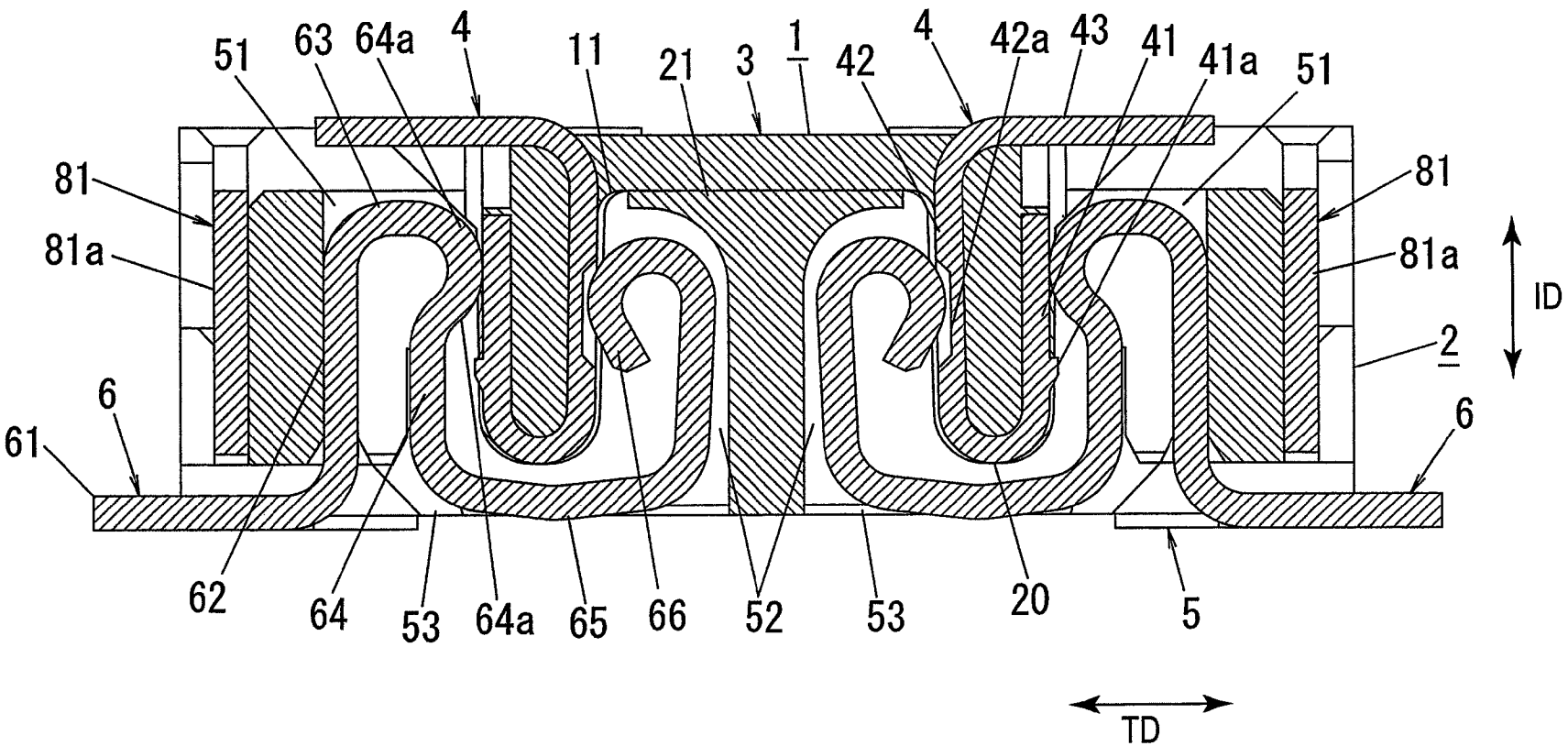
FIG. 3 is a sectional view in a cross section intersecting, at right angles, with a pitch direction showing a state where a header and a socket are connected to each other, and a sectional view in a cross section including a header contact and a socket contact.
Figure 4:
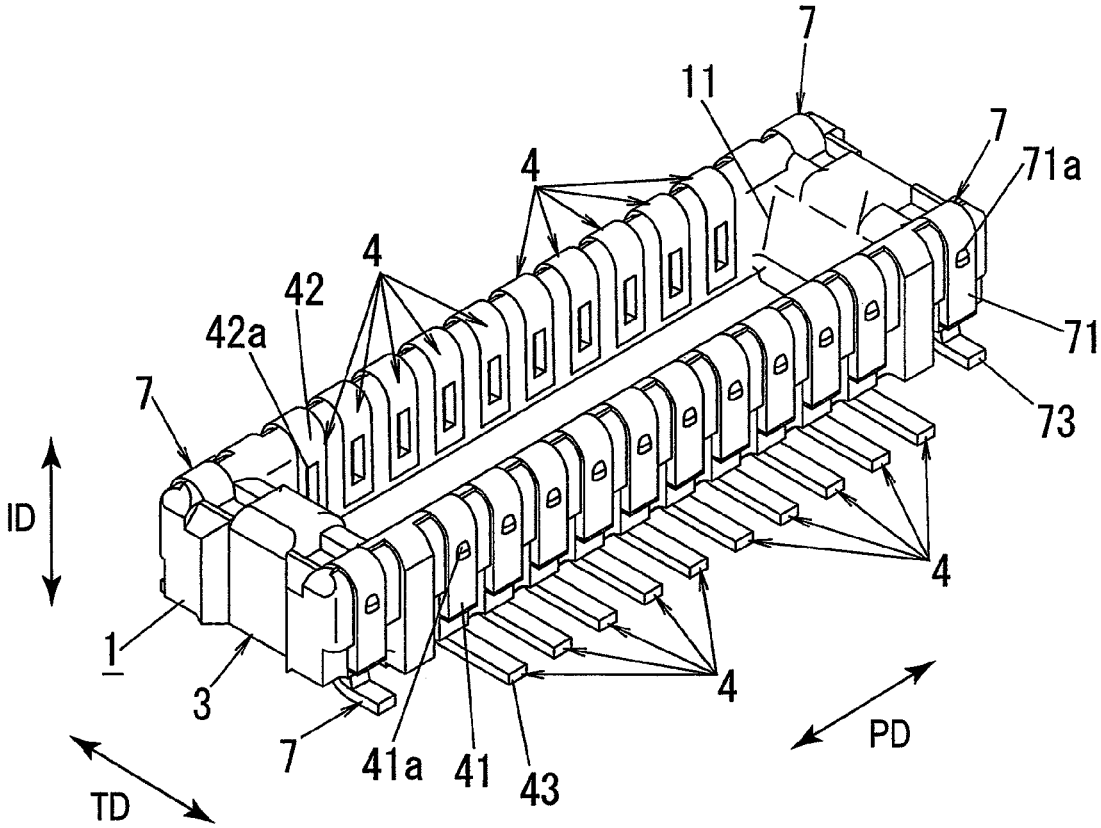
FIG. 4 is a perspective view showing the header.
Figure 5C:
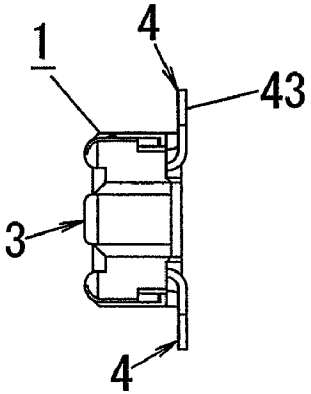
FIG. 5C is a right side view of the header.
Figure 5A:
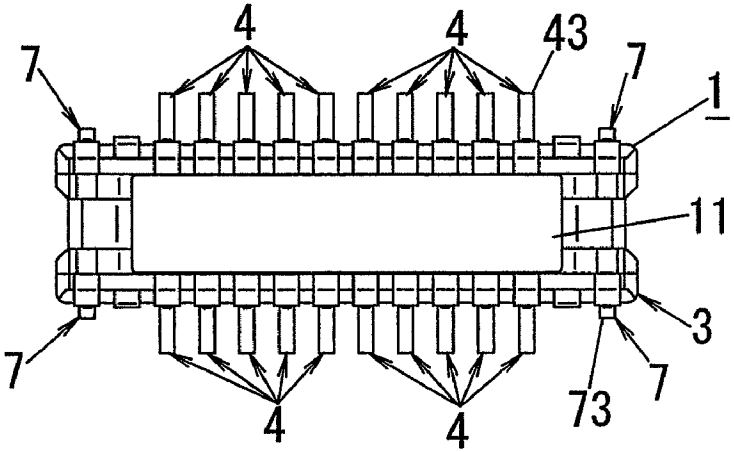
FIG. 5A is a plan view of the header.
Figure 5B:
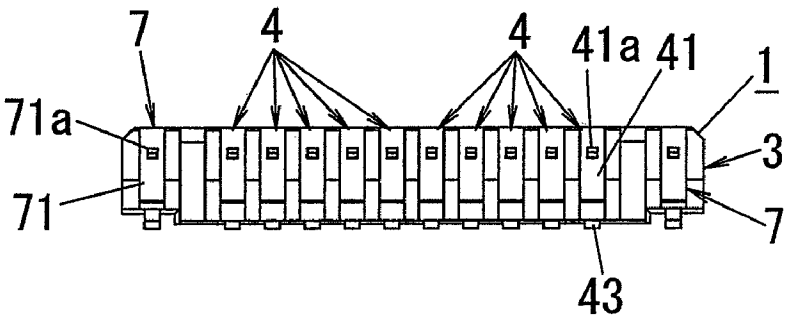
FIG. 5B is a front view of the header.
Figure 6A:
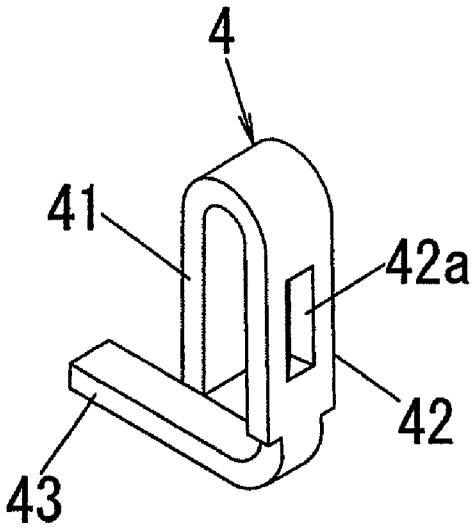
FIG. 6A is a perspective view showing the header contact.
Figure 6B:
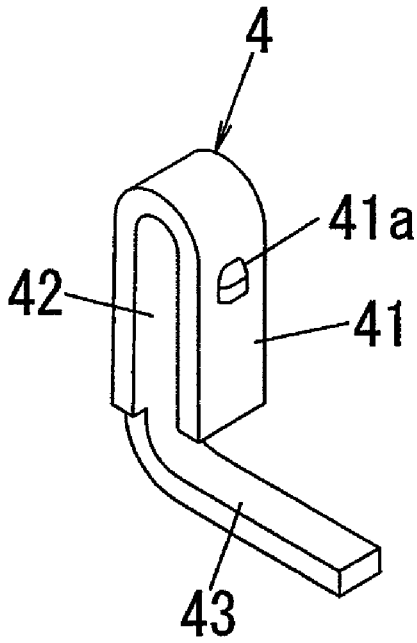
FIG. 6B is a perspective view showing the header contact as viewed from a different direction from that shown in FIG. 6A.
Figure 7B:
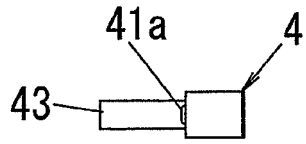
FIG. 7B is a plan view showing the header contact.
Figure 7E:
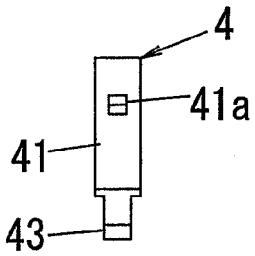
FIG. 7E is a left side view showing the header contact.
Figure 7A:
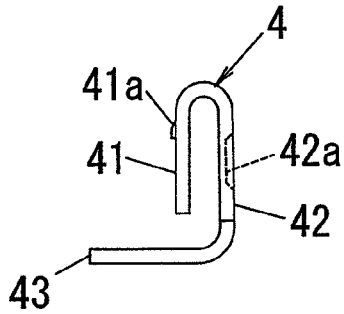
FIG. 7A is a front view showing the header contact.
Figure 7C:
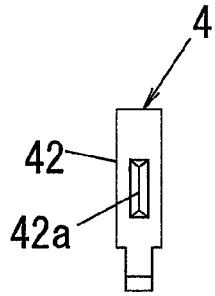
FIG. 7C is a right side view showing the header contact.
Figure 7D:
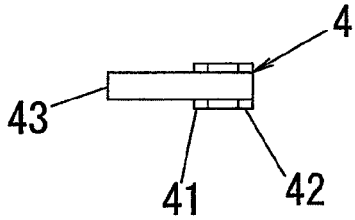
FIG. 7D is a bottom view showing the header contact.
Figure 8D:
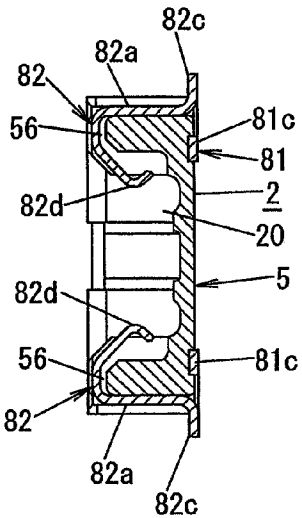
FIG. 8D is a sectional view of a cross section intersecting, at right angles, with the pitch direction showing the socket, and of a cross section including a contact portion of a terminal direction shield.
Figure 8C:
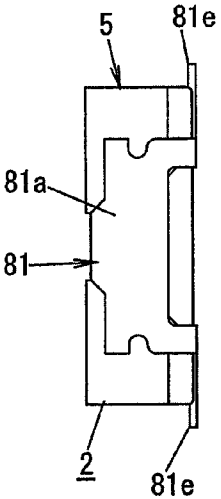
FIG. 8C is a right side view showing the socket.
Figure 8A:
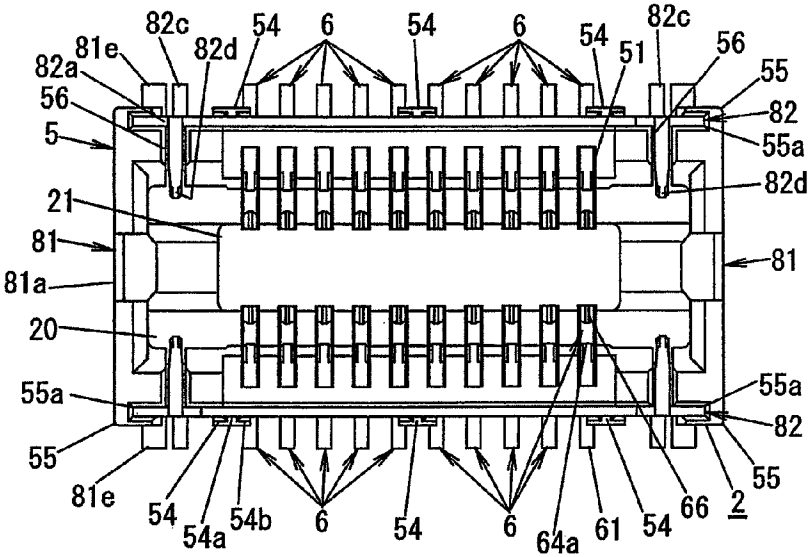
FIG. 8A is a plan view showing the socket.
Figure 8B:
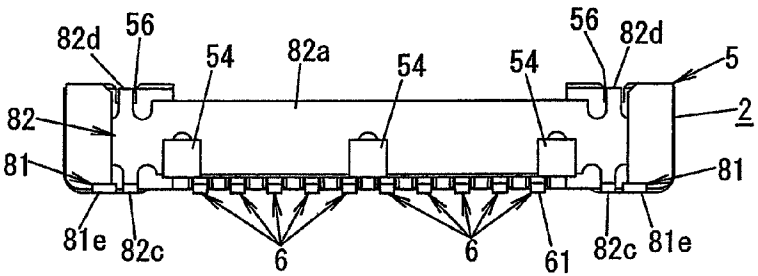
FIG. 8B is a front view showing the socket.
Figure 9A:
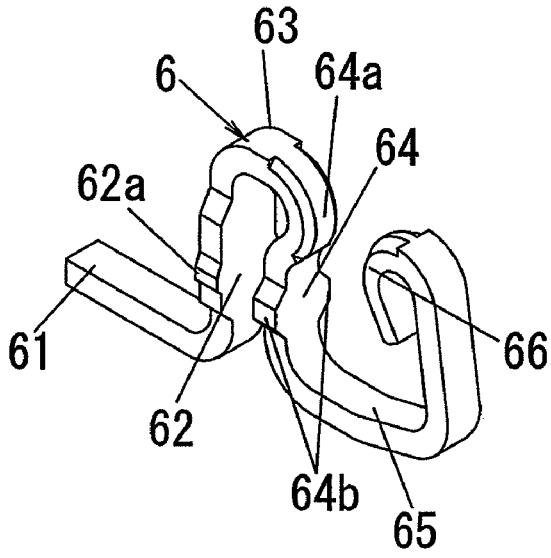
FIG. 9A is a perspective view showing a socket contact.
Figure 9B:
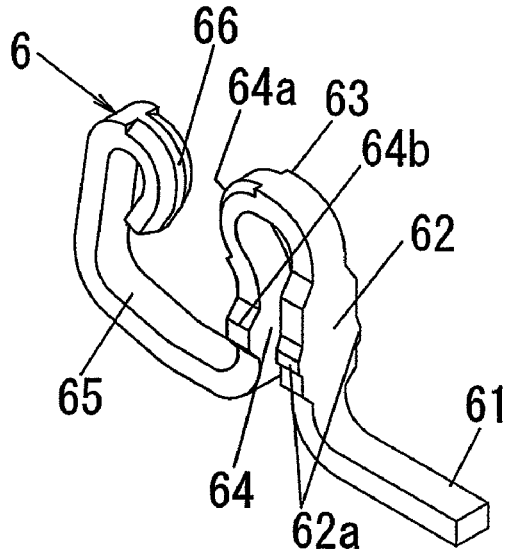
FIG. 9B is a perspective view showing the socket contact as viewed from a direction different from that shown in FIG. 9A.
Figure 10B:
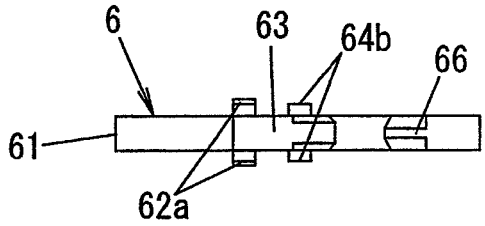
FIG. 10B is a plan view of the socket contact.
Figure 10E:
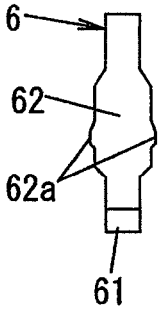
FIG. 10E is a left side view of the socket contact.
Figure 10A:
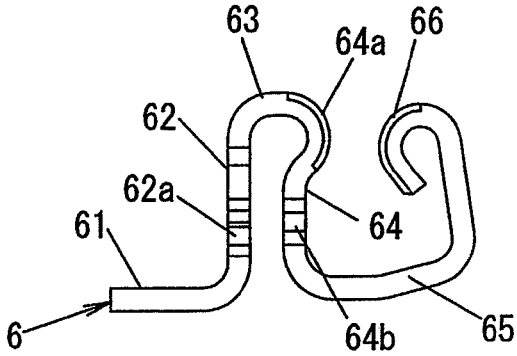
FIG. 10A is a front view of the socket contact.
Figure 10C:
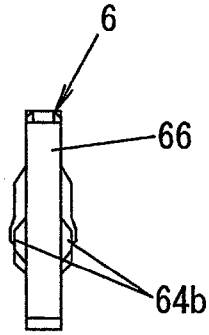
FIG. 10C is a right side view of the socket contact.
Figure 10D:
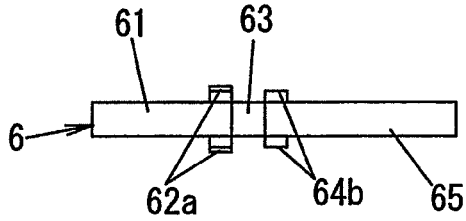
FIG. 10D is a bottom view of the socket contact.
Figure 11A:
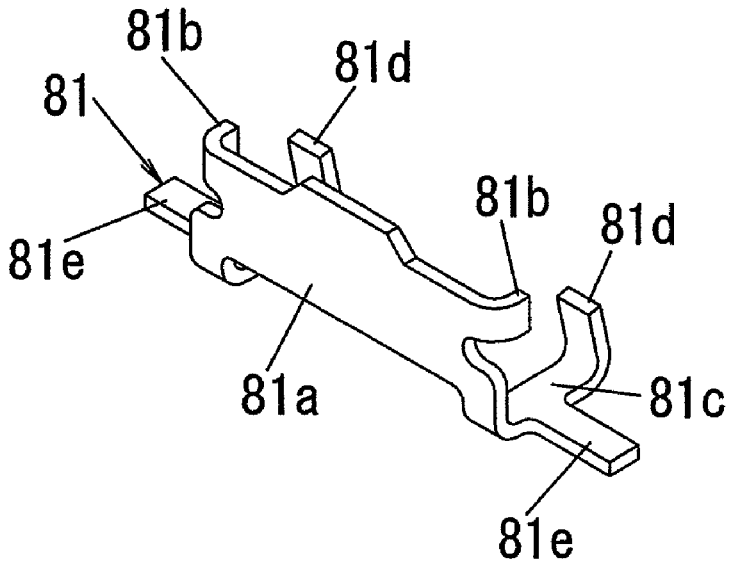
FIG. 11A is a perspective view showing a pitch direction shield.
Figure 11B:
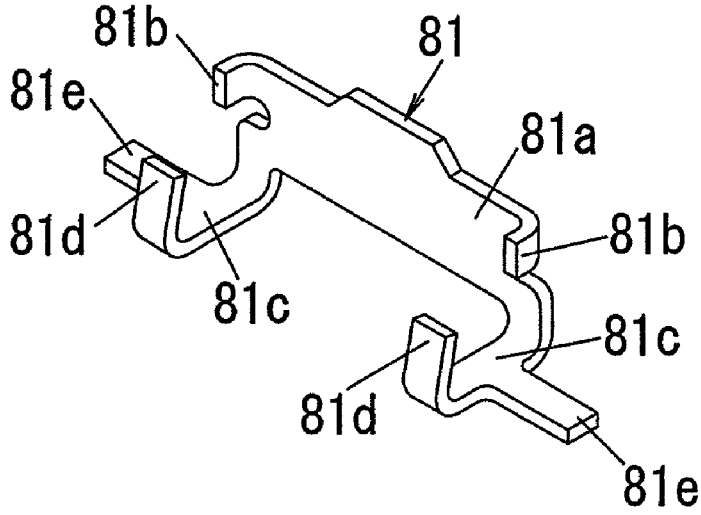
FIG. 11B is a perspective view showing the pitch direction shield as viewed from a direction different from that shown in FIG. 11A.
Figure 12B:
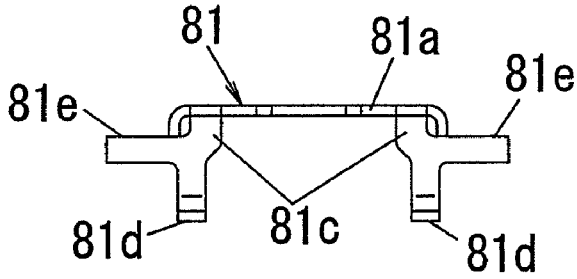
FIG. 12B is a plan view showing the pitch direction shield.
Figure 12A:
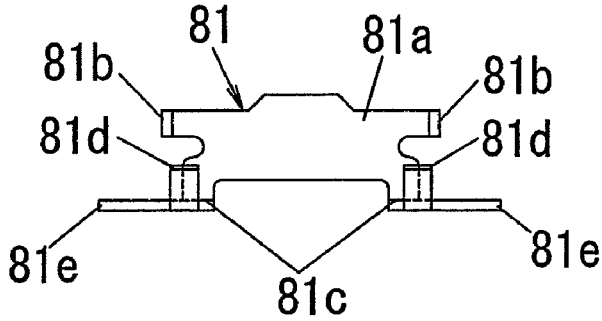
FIG. 12A is a front view showing the pitch direction shield.
Figure 12C:
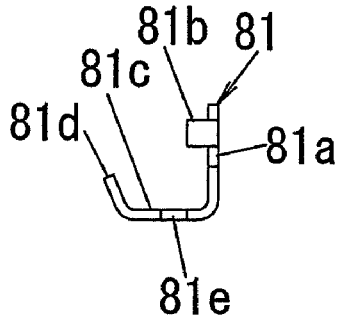
FIG. 12C is a right side view showing the pitch direction shield.
Figure 12D:
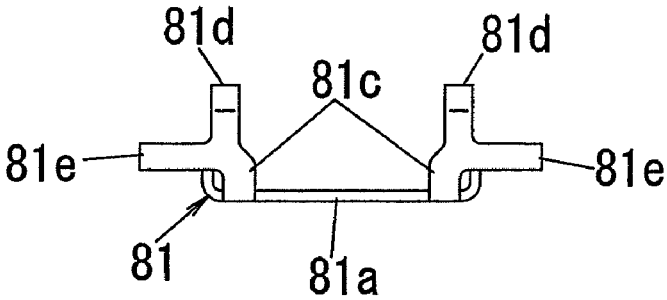
FIG. 12D is a bottom view showing the pitch direction shield.
Figure 13:
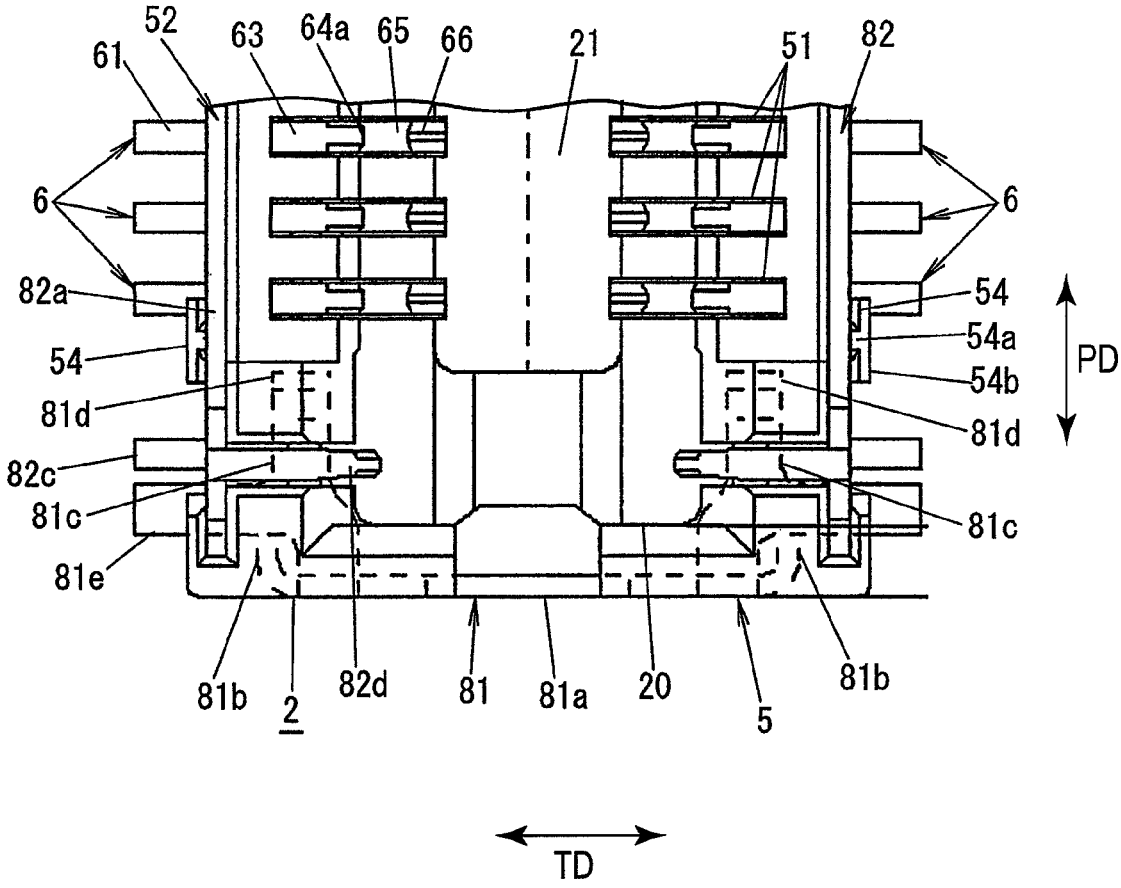
FIG. 13 is a plan view showing relevant parts of the socket.
Figure 14A:
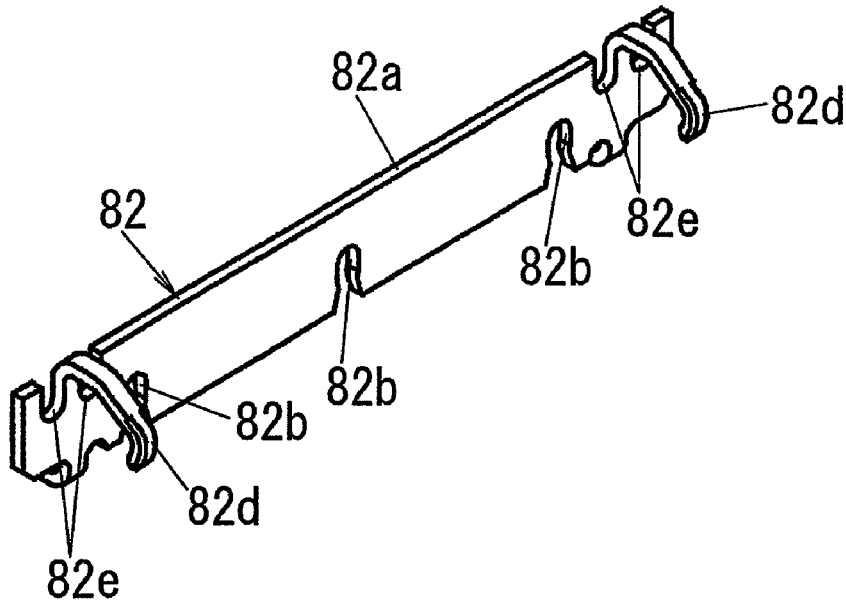
FIG. 14A is a perspective view showing a terminal direction shield.
Figure 14B:
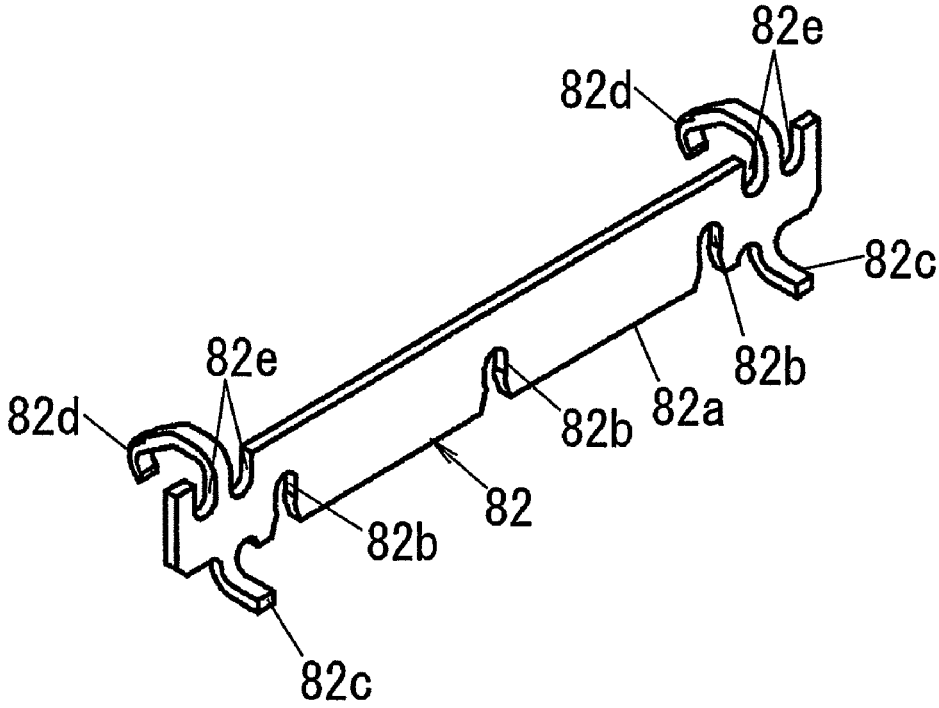
FIG. 14B is a perspective view showing the terminal direction shield as viewed from a direction different from that of FIG. 14A.
Figure 15B:
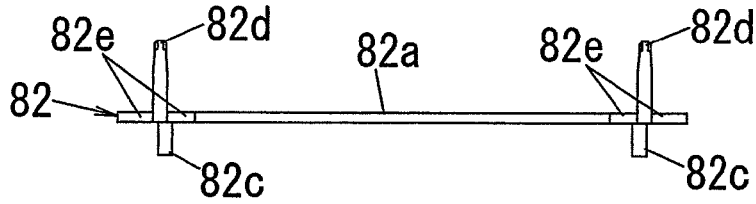
FIG. 15B is a plan view of the terminal direction shield.
Figure 15A:
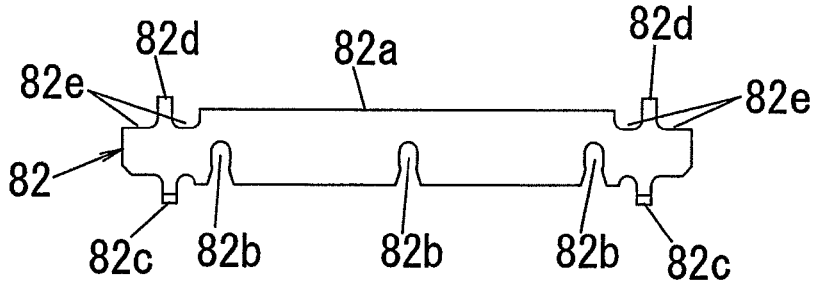
FIG. 15A is a front view of the terminal direction shield.
Figure 15C:
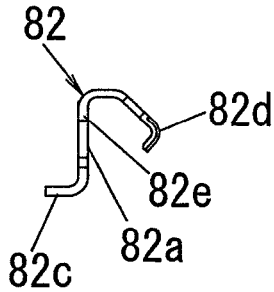
FIG. 15C is a right side view of the terminal direction shield.
Figure 15D:
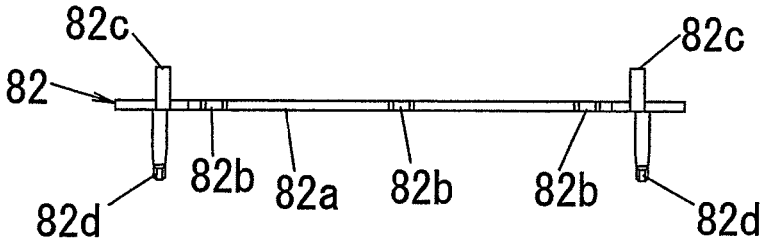
FIG. 15D is a bottom view of the terminal direction shield.

As shown in FIG. 3, a connector according to an embodiment of the invention includes a header 1 mounted on a first printed wiring board (not shown) and a socket 2 mounted on a second printed wiring board (not shown). The socket 2 includes a connection recess 20 into and from which the header 1 is inserted and pulled out. If the header 1 is inserted into the connection recess 20 in such a manner that the first printed wiring board and the second printed wiring board are opposed to each other, the first printed wiring board and the second printed wiring board are electrically connected to each other through the header 1 and the socket 2.

For convenience sake, the vertical direction and the lateral direction are defined based on FIG. 3. That is, a direction in which the header 1 is inserted into the connection recess 20 is called "downward", and a direction in which the header 1 is pulled out from the connection recess 20 is called "upward". The vertical direction in the following description is the insertion/withdrawal direction ID. A direction intersecting with a paper sheet of FIG. 3 at right angles is called "longitudinal direction".

As shown in FIGS. 4 and 5A to 5C, the header 1 includes a header body 3 made of insulation material such as synthetic resin, and header contacts 4. Two or more header contacts 4 are arranged in the longitudinal direction at left and right ends of the header body 3. The header body 3 is provided with an inner recess 11 which is long in the longitudinal direction.

As shown in FIGS. 6A, 6B and 7A to 7E, each header contact 4 includes a first contact portion 41 which is exposed from left and right outer side surfaces, and a second contact portion 42 which is formed into U-shape nipping left and right edges of the inner recess 11 together with the first contact portion 41, and which is exposed inward of the inner recess 11. The header contact 4 also includes a terminal 43 which extends outward in the lateral direction from an upper end of the second contact portion 42, which passes through a bottom surface of the inner recess 11, and which projects laterally along an upper end surface of the header body 3 and is mounted on the header contact 4. Each header contact 4 is held by the header body 3 by insert molding. The terminal 43 of the header contact 4 is soldered to a conductive pattern provided on the first printed wiring board, and the header contact 4 is electrically connected to the first printed wiring board.

As shown in FIGS. 2 and 8A to 8D, the socket 2 includes a socket body 5 which is made of insulation material such as synthetic resin and which is provided with a connection recess 20, and a plurality of socket contacts 6 held by the socket body 5 such that the socket contacts 6 are in conduction with the header contacts 4 inside the connection recess 20 in one-to-one correspondence with the header contacts 4 when the header 1 is inserted into the connection recess 20. In the present embodiment, total 20 header contacts 4 and socket contacts 6 are provided such that ten sets thereof are laterally arranged in two rows with their widthwise directions oriented in the longitudinal direction. That is, the longitudinal direction corresponds to the pitch direction PD.

Each of the header contact 4 and the socket contact 6 is made of long, thin and bent metal plate having elasticity and conductivity.

As shown in FIGS. 9A, 9B and 10A to 10E, the socket contact 6 includes a terminal 61 which is mounted such as to project outward in the lateral direction than the socket body 5 such that its thickness direction is oriented in the vertical direction, a held portion 62 which is extending upward from one of left and right ends of the terminal 61 located inward and which is held by the socket body 5, a first connecting portion 63 which is extended from an upper end of the held portion 62 into one of lateral directions away from the terminal 61, a first contact portion 64 which is extended downward from a tip end of the first connecting portion 63 and which comes into contact with the first contact portion 41 of the header contact 4, a second connecting portion 65 which is extended from a lower end of the first contact portion 64 into one of lateral directions away from the held portion 62, and a second contact portion 66 which is extended upward from a tip end of the second connecting portion 65 and which comes into elastic contact with the second contact portion 42 of the header contact 4 such as to nip the header contact 4 between the first contact portion 64 and the second contact portion 66. That is, the lateral direction corresponds to the terminal direction TD.

The first contact portion 64 is provided at its upper end with a curved engaged convex portion 64*a* which projects into one of lateral directions away from the held portion 62 than other portion of the first contact portion 64. In a state where the header 1 is in complete contact with the socket 2, the first contact portion 64 is in contact with the header contact 4 only in the engaged convex portion 64*a*.

The second connecting portion 65 is inclined upward as separating from the first contact portion 64. With this configuration, the second connecting portion 65 can elastically deform such that an end of the second connecting portion 65 on the side of the second contact portion 66 is displaced downward with respect to an end of the second connecting portion 65 on the side of the first contact portion 64.

A tip end of the second contact portion 66 is bent into a J-shape toward the second connecting portion 65. A convex curved surface of the second contact portion 66 formed by this bending comes into elastic contact with the header contact 4.

In the socket body 5, ten first contact accommodation grooves 51 are arranged in each of left and right ends of the connection recess 20. In each of the first contact accommodation grooves 51, the held portion 62 and the first connecting portion 63 of the socket contact 6 are accommodated one each. The engaged convex portion 64*a* elastically projects from the first contact accommodation groove 51.

A longitudinally long inner convex portion 21 inserted into the inner recess 11 of the header 1 projects from a central portion of a bottom surface of the connection recess 20, and 20 second contact accommodation grooves 52 are formed in the longitudinal direction in left and right surfaces of the inner convex portion 21. An inner end in the lateral direction of each of the socket contacts 6 is accommodated in each the second contact accommodation groove 52. An upper end of the second contact portion 66 elastically projects from the second contact accommodation groove 52.

Contact insertion holes 53 are vertically formed such as to penetrate the bottom surface of the connection recess 20 of the socket body 5 at locations corresponding to contacts. Each contact insertion hole 53 is in communication with the first contact accommodation groove 51 and the second contact accommodation groove 52. The socket contact 6 is mounted on the socket body 5 through from the held portion 62 to the second contact portion 66 from a portion below the socket body 5 through the contact insertion hole 53.

Press-fit convex portions 62*a* and 64*b* project respectively from the held portion 62 and the first contact portion 64 of the socket contact 6 to both sides of the longitudinal direction which is the widthwise direction in the central portion in the vertical direction.

The press-fit convex portions 62*a* and 64*b* are press-fitted into inner surfaces which are opposed in the longitudinal direction of the first contact accommodation groove 51 and with this configuration, the socket contacts 6 are held by the socket body 5. Longitudinal both surfaces of upper and lower ends of the press-fit convex portions 62*a* and 64*b* are inclined such that the projecting sizes toward the vertical direction are reduced, the inclined surfaces are guided by an inner surface of the first contact accommodation groove 51, and the socket contacts 6 can easily be introduced toward predetermined positions.

An engaging convex portion 41*a* projects outward in the longitudinal direction from the first contact portion 41 of the header contact 4. When the header 1 is inserted into the connection recess 20, the engaged convex portion 64*a* of the socket contact 6 rides over the engaging convex portion 41*a*. With this configuration, when the engaging convex portion 41*a* rides over the engaged convex portion 64*a*, an operator can sense a click feeling, and in a state where the header 1 and the socket 2 are connected to each other, a holding force is generated between the header 1 and the socket 2 by locating the engaged convex portion 64*a* below the engaging convex portion 41*a*. An inclined surface whose projecting size is increased upward is provided on a lower end of the engaging convex portion 41*a*. When the header 1 is inserted into the connection recess 20, the engaged convex portion 64*a* slides on the inclined surface, a force required for inserting the header 1 is reduced, and it becomes easy to connect the header 1 and the socket 2 with each other.

A surface of the second contact portion 42 oriented inward of the inner recess 11 is provided with a vertically long clearance hole 42*a*. The clearance hole 42*a* has V-shaped cross section which intersects with the vertical direction. A central portion of an outer surface of the second contact portion 66 of the socket contact 6 is a curved surface which is projected outward than both ends of the second contact portion 66 in the widthwise direction (longitudinal direction). With this configuration, in a state where the header 1 and the socket 2 are connected to each other, in both front and rear sides of the clearance hole 42*a*, the second contact portion 66 of the socket contact 6 comes into elastic contact with an opening edge of the clearance hole 42*a*. When a foreign matter is adhered to the second contact portion 42 or 66 of the socket contact 6 or the header contact 4 before the header 1 and the socket 2 are connected to each other, the foreign matter is pushed by the second contact portion 66 of the socket contact 6 when the header 1 is inserted into the connection recess 20, the foreign matter is dropped into the clearance hole 42*a* and the foreign matter is not nipped between the header contact 4 and the socket contact 6. That is, the reliability of connection is enhanced by the clearance hole 42*a*.

In both front and rear ends of the header body 3, on both left and right sides, a ground contact 7 which is electrically connected to a ground pattern (not shown) that is a conductive pattern provided on the first printed wiring board and electrically connected is held. More specifically, the ground contact 7 includes a contact portion 71 which is exposed on left and right outer surfaces of the header body 3, a held portion 72 which is formed into U-shape together with the contact portion 71 and which is embedded in the header body 3, and a terminal 73 which is extended outward in the lateral direction from an upper end of the held portion 42, which projects laterally along an upper end surface of the header body 3 and which is soldered to the ground pattern. The ground contact 7 is held by the header body 3 by insert molding like the header contact 4. In the present embodiment, the terminal 73 of the ground contact 7 is shorter than the terminal 43 of the header contact 4, and other portion of the terminal 73 has the same shape as that of the header contact 4. That is, the contact portion 71 of the ground contact 7 is provided with an engaging convex portion 71*a* that is the same as the engaging convex portion 41*a* of the first contact portion 41, and the held portion 72 of the ground contact 7 is provided with a recess 72*a* that is the same as the clearance hole 42*a* of the second contact portion 42 of the header contact 4. Since the held portion 72 of the ground contact 7 is embedded in the header body 3 and is not exposed unlike the second contact portion 42 of the header contact 4, the recess 72*a* does not have an effect for enhancing the connection reliability like the clearance hole 42*a*, but has an effect for strengthening the holding force of the header body 3 with respect to the ground contact 7 because synthetic resin constituting the header body 3 flows into the recess 72*a*. Since the ground contact 7 and the header contact 4 have substantially the same shapes, the ground contact 7 and the header contact 4 can have common steps except a step for forming the terminals 43 and 73 at the time of production and thus, the producing cost can be reduced as compared with a case that the ground contact 7 and the header contact 4 have quite different shapes.

The socket 2 according to the present embodiment is provided with the pitch direction shield 81 and the terminal direction shields 82 constituting an annular shell surrounding the connection recess 20 as viewed from the vertical direction. The pitch direction shields 31 and the terminal direction shields 82 are provided two each, the pitch direction shield 81 is formed on both front and rear ends of the socket body 5 one each by insert molding, and the terminal direction shield 82 is held on both left and right sides of the socket body 5 one each. The pitch direction shield 81 and the terminal direction shield 82 are formed by stamping and bending metal plates.

More specifically, as shown in FIGS. 11A, 11B, 12A to 12E and 13, the pitch direction shield 81 includes a body portion 81*a* having a thickness direction oriented in the longitudinal direction and an outward surface in the longitudinal direction is exposed from the socket body 5, first held portions 81*b* which project outward from left and right ends of an upper end of the body portion 81*a* and which are bent inward in the longitudinal direction and embedded in the socket body 5, connecting portions 81*c* which project from left and right ends of the body portion 81*a* and bent inward in the longitudinal direction, and which have lower surfaces exposed outside of the socket body 5, second held portions 81*d* which project upward from tip ends of the connecting portions 81*c* and embedded in the socket body 5, and terminals 81*e* which outwardly projected in the lateral direction from central portions of the connecting portions 81*c* in the longitudinal direction. The terminals 81*e* of the pitch direction shields 81 project outward in the lateral direction than the socket body 5 as viewed from the vertical direction. Since each pitch direction shield 81 is insert molded in the socket body 5, the mechanical strength of the end of the socket body 5 in its longitudinal direction (pitch direction PD) is enhanced as compared with a case that the pitch direction shield 81 is not insert molded in the socket body 5. Therefore, the thickness of the end can be reduced and can be made small in size while maintaining the mechanical strength. Further, as compared with a case that the pitch direction shield 81 is held by the socket body 5 by press-fit, it is possible to reduce the variation in position of the terminal 81*e* of the pitch direction shield 81.

As shown in FIGS. 14A, 14B and 16A to 16E, each terminal direction shield 82 includes the body portion 82*a* held by the socket body 5 such that the thickness direction is oriented in the lateral direction. A lower end of the body portion 82*a* of the terminal direction shield 82 is provided with three press-fit notches 82*b* which are opened downward, leftward and rightward. The press-fit notches 82*b* are arranged in the longitudinal direction. Three press-fit convex portions 54 project outward from locations of the left and right surfaces of the socket body 5 corresponding to the press-fit notches 82*b*, the press-fit convex portions 54 are press-fitted to the press-fit notches 82*b*, and the terminal direction shields 82 are held by the socket body 5. With this configuration, as compared with a case that the terminal direction shield 82 has a structure in which the socket body 5 is nipped from inside and outside of the accommodation recess 20, the shape of the terminal direction shield 82 can be simplified.

Each press-fit convex portion 54 includes a press-fit portion 54*a* press-fitted into the press-fit notch 82*b*, and flanges 54*b* projecting from front and rear sides from the tip end of the press-fit portion 54*a*, and a cross section intersecting with the vertical direction at right angles has a T-shape. Holding convex portions 55 project outward in the lateral direction from left and right sides of front and rear ends of the socket body 5. The holding convex portions 55 project more than other portions of the socket body 5. An upwardly opened holding recess 55*a* is provided in an inward surface of the holding convex portion 55 in the longitudinal direction. One of front and rear ends of the terminal direction shield 82 is accommodated in the holding recess 55*a*. The terminal direction shield 82 is provided with a flange 54*b* of the press-fit convex portion 54 located outside in the lateral direction. Both ends in the longitudinal direction of the terminal direction shield 82 are accommodated in the holding recess 55*a*, and this suppresses displacement of the terminal direction shield 82 in a direction of the longitudinal direction away from the connection recess 20.

The terminal direction shield 82 is provided at its front and rear ends with terminals 82*c*. Portions of the terminals 82*c* extending downward from the body portion 82*a* are bent outward in the lateral direction, and the terminals 82*c* project outward in the lateral direction than the socket body 5 as viewed from the vertical direction. The terminal direction shield 82 is also provided at its front and rear ends with contact portions 82*d*. Portions of the contact portions 82*d* extending upward from the body portion 82*a* are bent inward in the lateral direction, and the contact portions 82*d* elastically project inward of the connection recess 20. Notches 82*e* are provided on front and rear sides of the contact portion 82*d* in an upper end of the body portion 82*a* of the terminal direction shield 82. A vertical size of the notch 82*e* is smaller than other portion thereof. The notch 82*e* may not extend to front and rear ends as shown in FIG. 14, or may extend to the front and rear ends as shown in FIGS. 15A to 15D (left and right in FIG. 15A). Laterally opened insertion grooves 56 are provided in left and right sides of the connection recess 20 in front and rear ends of an upper surface of the socket body 5. Since the contact portions 82*d* of the terminal direction shields 82 are introduced into the connection recesses 20 through the insertion grooves 56, the contact portions 82*d* do not project more than the upper surface of the socket body 5.

Figure 16:
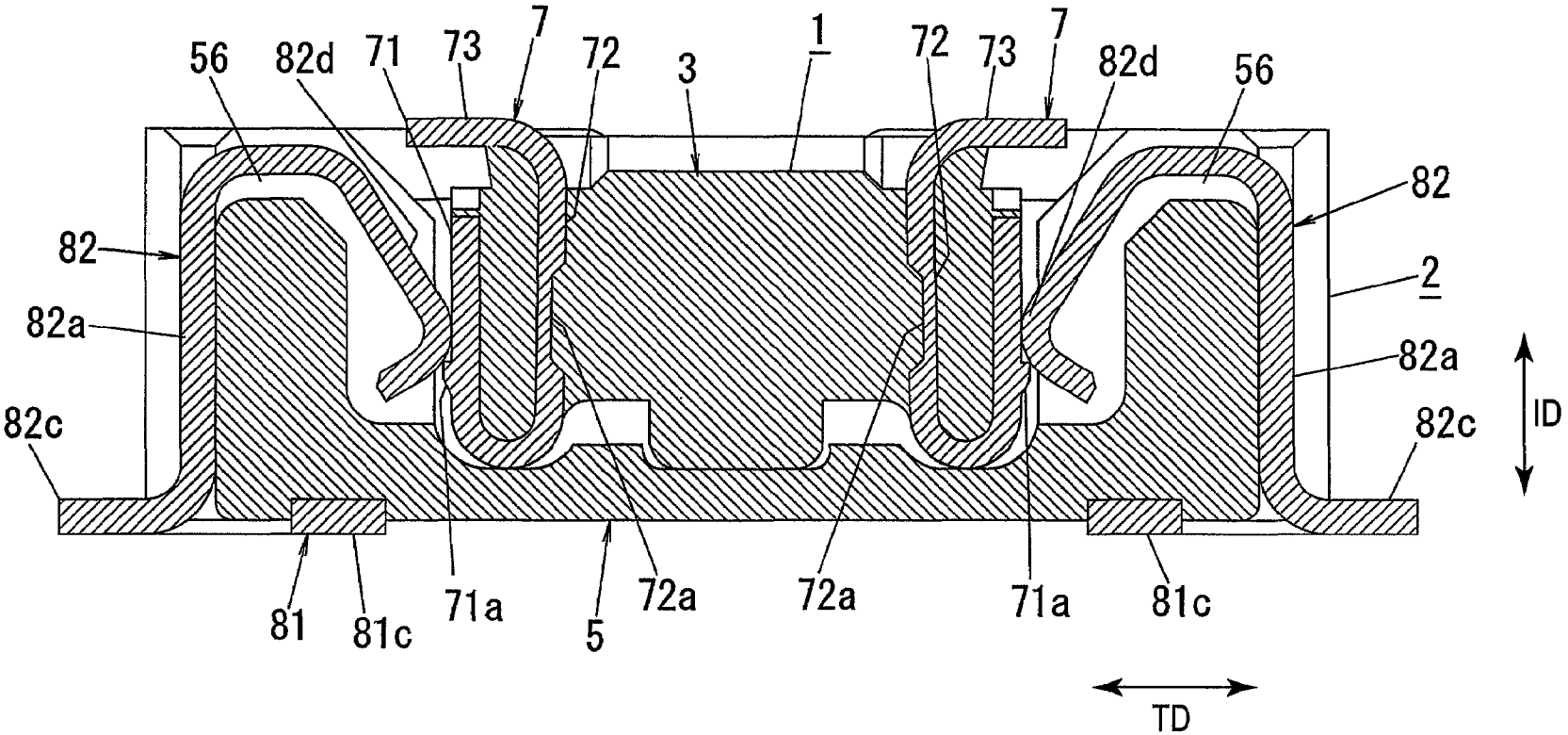
FIG. 16 is a sectional view showing a state where the header and the socket are connected to each other, and is a sectional view of a cross section intersecting with the pitch direction at right angles, and of a cross section including a contact portion between a ground contact and the terminal direction shield.

If the header 1 is inserted into the connection recess 20 of the socket 2, as shown in FIG. 16, the contact portion 82 of the terminal direction shield 82 is brought into contact and conduction with the contact portion 71 of the ground contact 7. A tip end of each of the contact portions 82 of the terminal direction shield 82 is bent toward the body portion 82*a*, and the contact portion 82 is brought into contact and conduction with the contact portion 71 of the ground contact 7 in the convex surface formed by bending. The ground pattern of the first printed wiring board and the ground pattern of the second printed wiring board are electrically connected with each other through the ground contact 7 and the terminal direction shield 82. Since the contact portion 82 is located on the upper side of the engaging convex portion 71*a* of the ground contact 7, a coupling force between the header 1 and the socket 2 is generated. With this configuration, as compared with a case that hardware for generating the coupling force is separately provided, the number of parts and the size can be reduced.

The terminals 81*e* and 82*c* of the pitch direction shield 81 and the terminal direction shield 82 are soldered to the ground pattern which is a conductive pattern electrically provided on the second printed wiring board and connected to the ground. A distance between mutually close terminal 81*e* of the pitch direction shield 81 and the terminal 82*c* of the terminal direction shield 82 is smaller than a distance between the terminals 61 of the adjacent socket contacts 6, and it is easy to collectively solder the mutually adjacent terminals 81*e* and 82*c* to the common ground pattern.

In the present embodiment, both the pitch direction shield and the terminal direction shield have the terminals which are soldered to the ground pattern. Therefore, as compared with a case that the terminal is connected to the pitch direction shield and the ground through the terminal direction shield like the conventional technique, the connection reliability between the pitch direction shield and the ground can be enhanced.

In the present embodiment, in the socket body, the pitch direction shield is an insert molded synthetic article. Thus, as compared with a case that the pitch direction shield is not insert molded in the socket body, the mechanical strength of the end of the socket body in the pitch direction is enhanced and thus, the thickness of the end can be reduced and made small in size while maintaining the mechanical strength. Further, as compared with a case that the pitch direction shield is held by the socket body by press fit, it is possible to reduce the variation in position of the terminal of the pitch direction shield.

In the present embodiment, at least one press-fit rib project from each of both side surfaces of the socket body in the terminal direction, each terminal direction shield is formed with the press-fit notch into which the press-fit rib is press-fitted, the press-fit rib is press-fitted into the press-fit notch, and the terminal direction shield is held by the socket body. Hence, the structure that should be provided in the terminal direction shield for holding the terminal direction shield on the socket body can be limited only to the press-fit notch having relatively simple shape.

In the present embodiment, both ends of the header in a direction corresponding to the terminal direction are provided with the ground contact which is made of conductive material, which is held by the header body, and which is electrically connected to the ground pattern of the first printed wiring board. Each the terminal direction shield has the contact portion which is made of elastically deformable material, and which comes into elastic contact with the ground contact of the header inserted into the connection recess from a direction intersecting with the insertion/withdrawal direction. Hence, by elastically bringing the contact portion of the terminal direction shield into elastic contact with the ground contact of the header, the ground pattern of the first printed wiring board and the ground pattern of the second printed wiring board can be electrically connected to each other through the ground contact and the terminal direction shield. Since the elastically connecting direction is a direction intersecting with the insertion/withdrawal direction, a coupling force between the header and the socket can be generated.

The present invention can be carried out as a connector such as a connector between wiring boards.

CROSS REFERENCE TO RELATED APPLICATION

This application is based upon and claims the benefit of priority from a Japanese Patent Application No. 2007-226880, filed on Aug. 31, 2007; the entire contents of which are incorporated herein by reference.

What is claimed is:

1. A connector comprising a header mounted on a first printed wiring board, and a socket mounted on a second printed wiring board opposed to the first printed wiring board, wherein the header includes a header body made of an insulation material, and a plurality of header contacts which are each held by the header body and electrically connected to the first printed wiring board, the socket includes a socket body which is made of an insulation material and which is provided with a connection recess into and from which the header is removably connected, a plurality of socket contacts which are each held by the socket body and electrically connected to the second printed wiring board such that the socket contacts are brought into contact and conduction with the corresponding header contacts inside the connection recess when the header is inserted into the connection recess, and a shell which is made of a conductive material and which is held by the socket body such as to surround a periphery of the connection recess as viewed from an insertion/withdrawal direction of the header, each of the socket contacts includes terminals which project from the socket body as viewed from the insertion/withdrawal direction and which are soldered to the second printed wiring board, the socket is provided with a plurality of pairs of socket contacts in which terminal directions as terminal projecting directions from the socket body are opposite from each other are arranged in a pitch direction which is a direction intersecting with the insertion/withdrawal direction and the terminal direction, the shell includes pitch direction shields which are provided on both ends of the socket body in the pitch direction, and terminal direction shields which are provided on both ends of the socket body in the terminal direction, the pitch direction shields and the terminal direction shields have corresponding terminals, and the terminals of the pitch direction shield and the terminals of the terminal direction shield are soldered to a common ground pattern provided on the second printed wiring board.

2. The connector according to claim 1, wherein the socket body is a synthetic resin molded article in which the pitch direction shield is insert molded.

3. The connector according to claim 1, wherein at least one press-fit rib projects from each of both side surfaces of the socket body in the terminal direction, and the terminal direction shields are formed with press-fit notches to which the press-fit ribs are press fitted, and the terminal direction shield is held by the socket body by press fitting the press-fit ribs into the press-fit notches.

4. The connector according to claim 1, wherein both ends of the header in a direction corresponding to the terminal direction are formed with ground contacts which are made of conductive material, are held by the header body and which are electrically connected to a ground pattern of the first printed wiring board, the terminal direction shield includes contact portions which are made of elastically deformable material, and which come into elastic contact with the ground contact of the header inserted into the connection recess from a direction intersecting with the insertion/withdrawal direction.

* * * * *